United States Patent [19]

Motoyama et al.

[11] Patent Number: 4,570,138

[45] Date of Patent: Feb. 11, 1986

[54] BALANCED ARMATURE TYPE RELAY

[75] Inventors: Masanori Motoyama; Toyotaka Nishikawa, both of Osaka, Japan

[73] Assignee: Matsushita Electric Works, Ltd., Osaka, Japan

[21] Appl. No.: 574,730

[22] Filed: Jan. 30, 1984

[30] Foreign Application Priority Data

Jan. 31, 1983 [JP] Japan ..... 58-14144
Jan. 31, 1983 [JP] Japan ..... 58-12534[U]

[51] Int. Cl.[4] ..... H01H 51/22

[52] U.S. Cl. ..... 335/80; 335/78; 335/84

[58] Field of Search ..... 335/78, 79, 80, 81, 335/82, 83, 84, 85, 128, 203, 230, 231, 232, 270, 276

[56] References Cited

FOREIGN PATENT DOCUMENTS 0040778 12/1981 European Pat. Off. .
2537462 3/1976 Fed. Rep. of Germany .
2314576 1/1977 France .
2435799 4/1980 France .
195824 4/1923 United Kingdom ..... 335/80

*Primary Examiner*—Thomas H. Tarcza
*Assistant Examiner*—George Andrews
*Attorney, Agent, or Firm*—Schwartz, Jeffery, Schwaab, Mack, Blumenthal & Evans

[57] ABSTRACT

A balanced armature type relay includes a coil assembly 2 with a coil 20 and an ion core 21 extending through the coil 20, an armature assembly with a pair of frame-shaped upper and lower armatures 3, 4 disposed parallel to each other and so as to surround the coil 20, and a pair of contact units 6, 8 operated by the armature assembly. The coil 20 is covered with a molded portion 23 which has a pair of lateral studs 24 integrally formed with it, the studs 24 defining a horizontal axis about which the armature assembly is pivotal. High accuracy in the positional relation between the pole faces formed by extending ends of the iron core 21 and the respective ends of the armatures 3, 4 cooperating with the pole faces is achieved by the fact that both the pole faces provided on the iron core 21 and the studs 24 form part of the coil assembly which is formed as one common block. At the same time, a very thin relay is obtained since the overall vertical dimension of the relay may be restricted to the height of the coil.

8 Claims, 7 Drawing Figures

BALANCED ARMATURE TYPE RELAY

DESCRIPTION

Figure 1:
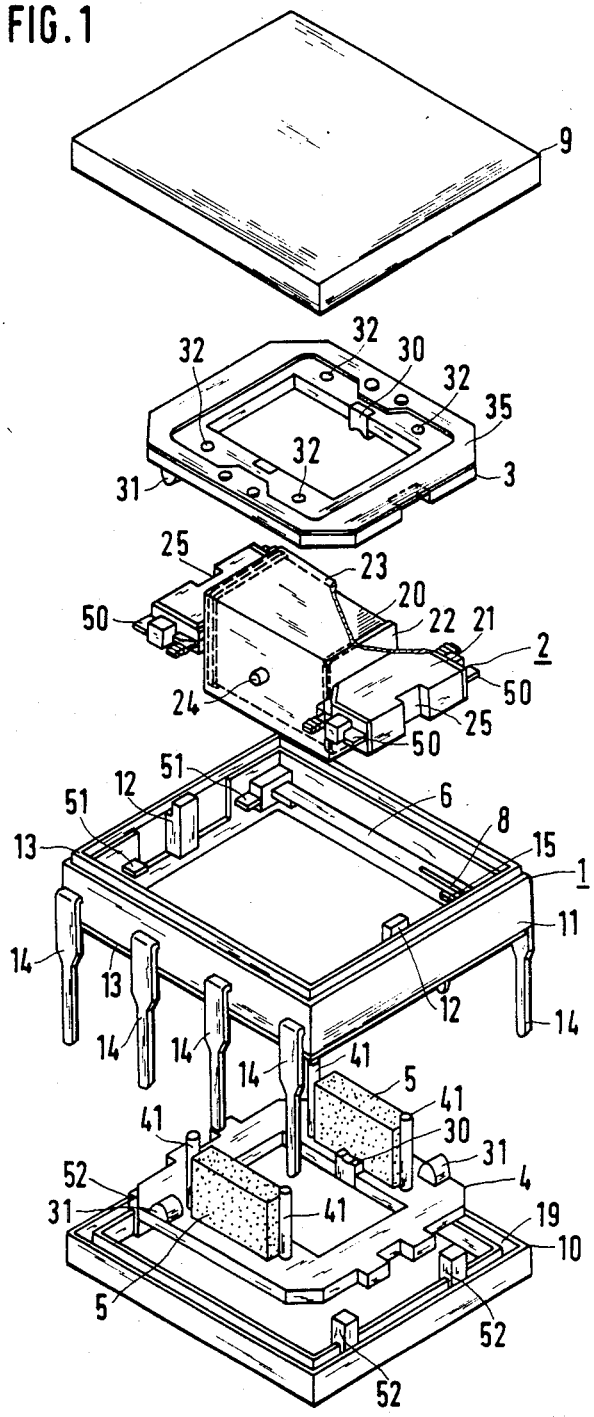

This invention relates to a balanced armature type relay, particularly to a polarized relay of this type having four air gaps.

A conventional four-gap balanced armature type relay includes a pair of armatures pivotally supported above or below a coil for rotation in a horizontal plane, which inevitably creates the problem that the overall vertical dimension of the relay becomes large. Further, the shafts for supporting the armatures are disposed on a member which is separate from the coil, so that the relative positional accuracy between the coil and the axis of the shafts, thus between the end portions of an iron core extending through the coil and the armatures cooperating with these end portions is limited, thus involving the problem that a desired relay characteristic is difficult to reproduce.

It is an object of the present invention to provide a balanced armature type relay which is thin in the vertical dimension, at the same time exhibiting high accuracy in the positional relation between the armatures and the end portions of the iron core, thereby achieving stable relay characteristics.

A further object of the invention is to devise a relay of the above type sealed in a casing with a high sealing effect.

Another object of the invention is to provide a relay of the above type which has a high withstand voltage between the coil and the contacts.

In view of these objects, the present invention provides a balanced armature type relay which comprises a coil assembly covered by a molded portion and including a coil and a core penetrating through the coil and having end portions extending from the coil; an armature assembly including a pair of upper and lower armatures having end portions disposed opposite said core end portions, the armature assembly being pivotal about an axis defined by a pair of studs integrally formed at opposite lateral sides of said molded portion; and at least one contact unit positioned laterally of said coil assembly between said upper and lower armatures and including a fixed contact and a movable contact operated by said armature assembly for cooperation with said fixed contact.

Since the studs are integral with the coil assembly, the positional relation between the armatures and the end portions of the core extending through the coil is reproduceable with close tolerances. Further, since the pair of armatures are supported laterally of the coil for pivotal movement about the horizontal axis defined by the lateral studs, and since the contact units are positioned between the armatures, the overall structure has a vertical dimension limited to the height of the coil assembly.

An advantageous development of the invention provides a casing which includes a frame member mounting said coil assembly and contact unit and having terminals connected to said coil and contact unit and extending to the outside of the frame member; and upper and lower covers having peripheral portions engaging opposite edges of the frame member for sealingly enclosing said coil and armature assemblies and contact units; wherein in either pair of mutually engaging cover peripheral portion and frame edge, one has a projection and the other has a groove receiving the projection, with a sealant being inserted between the groove and projection. With this structure, the connecting surfaces between the casing portions is large and the sealant is accordingly spread over a large area. In addition, if the individual casing portions should have different contraction rates, compression occurs between certain surfaces of the mutually engaging groove and projection, thereby enhancing the sealing effect.

According to another advantageous development of the invention, said coil has at least two end portions and at least two of said terminals have inner end portions connected to said coil end portions; and ribs are formed integrally with said upper and lower covers adjacent said frame member so as to project inwardly of said casing and bear against outer surfaces of said interconnected coil and terminal end portions. Accordingly, when the casing portions are sealed to each other, insulation at the connecting parts of the coil terminals is improved by a capillary action of the sealant occurring between the connecting parts and the ribs bearing there against, thereby improving the insulation between the coil and the contacts, to increase the breakdown voltage of the relay.

Figure 2:
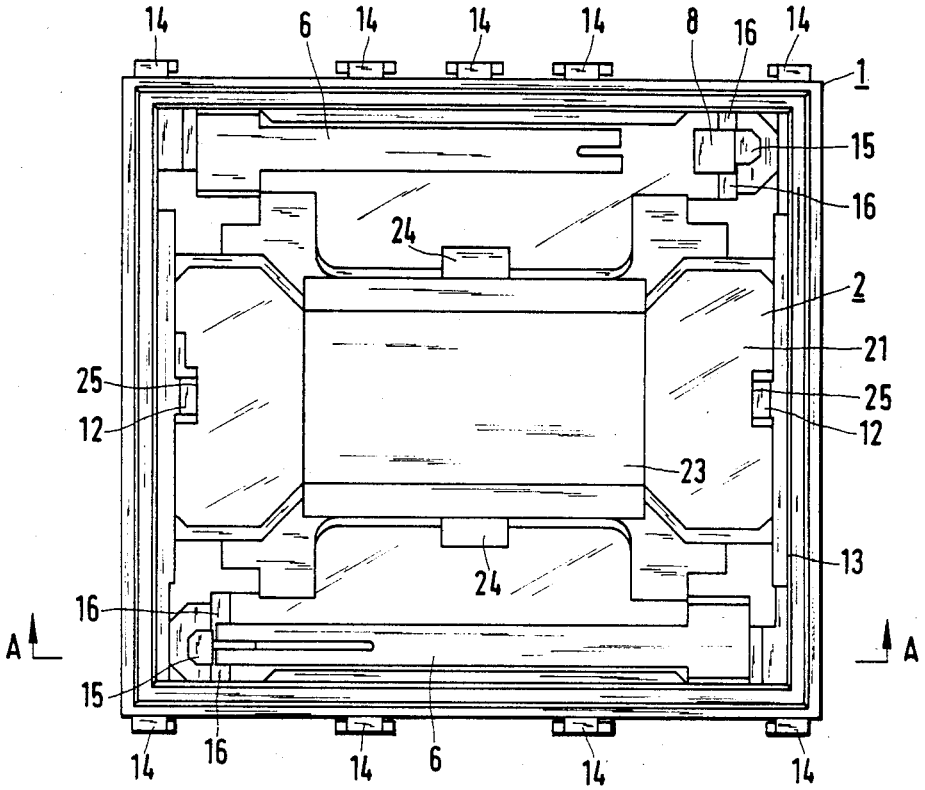
Figure 3:
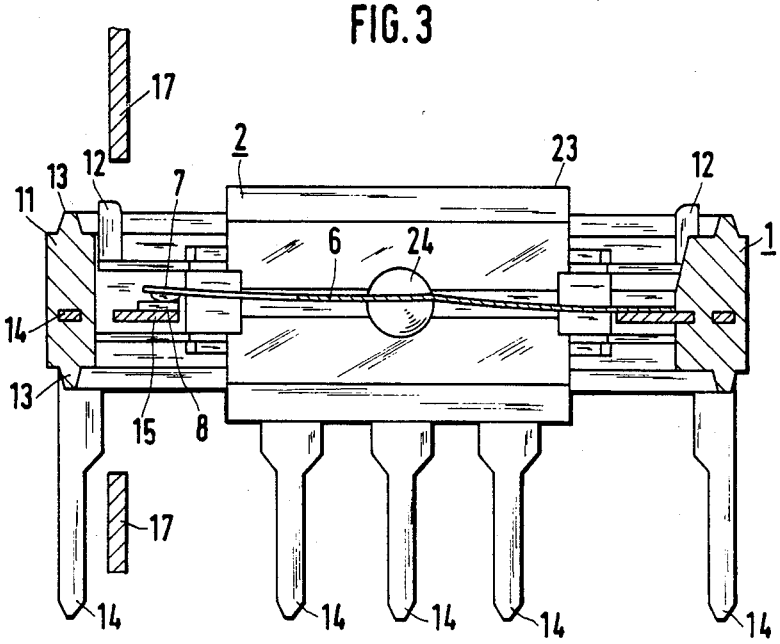
Figure 4:
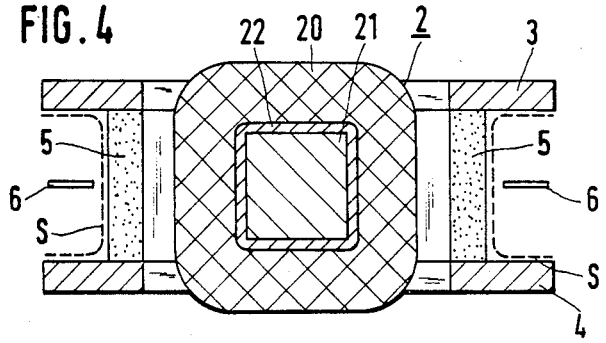
Figure 5:
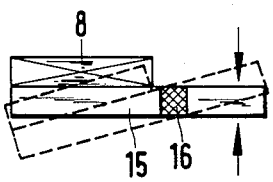
Figure 6:
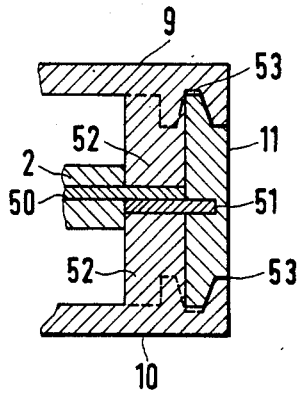
Figure 7:
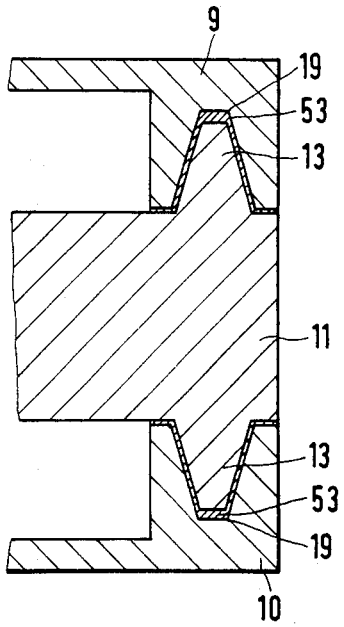

Preferred embodiments will now be described with reference to the drawings in which FIG. 1 is a perspective exploded view of a polarized, balanced armature type relay, FIG. 2 is a plan view of the relay of FIG. 1 in its assembled condition with the upper cover and upper armature removed, FIG. 3 is a sectional view of the relay taken along the line A—A of FIG. 2 with the lower armature and lower cover also omitted, FIG. 4 shows a vertical section through the coil and armature assemblies and the movable contact springs to show the positional relation between these elements, FIG. 5 is a detailed view of a fixed contact of the relay, FIG. 6 is a cross-sectional view through the relay showing a part of the casing and coil assembly, and FIG. 7 shows another cross-section through the casing of the relay.

The relay shown in the drawings comprises a casing 1 including a rectangular frame member 11 and upper and lower covers 9 and 10. As shown in detail in FIG. 7, the lower rim of the upper cover 9 and the upper rim of the lower cover 10 are each provided with a groove 19, and projecting ridges 13 fitting into the grooves 19 are provided on the top and bottom edges of the frame 11. The contact surfaces between the frame 11 and each of the covers 9 and 10 is thus rather large, thus providing a large area over which sealant 53 can spread. If there is a difference in the contraction rates between the frame 11 and the covers 9 and 10, either of the side surfaces of the ridge 13 will be inevitably subjected to compression by the corresponding surface of the groove 19, thereby enhancing the sealing effect. Rather than forming ridges 13 on the frame 11, as shown in FIG. 7, it is also possible to provide ridges on the covers 9 and 10 and corresponding grooves in the frame 11.

As best seen in FIGS. 1 to 3, the frame 11 carries a pair of movable contact springs 6 and fixed contacts 8, the free end of each spring 6 having a contact portion 7 for cooperation with the respective fixed contact 8.

A plurality of terminals 14 is embedded in the frame 11, each terminal 14 having a connecting portion extending to the outside of the frame 11, and an inner connecting portion for engagement with a corresponding connecting portion of the coil and contacts. Two of these inner connecting portions 51 of two corresponding terminals 14 are shown in FIG. 1.

A coil assembly generally referenced by numeral 2 includes a coil 20 wound on a bobbin 22 and an iron core 21 extending through the bobbin and coil. End portions of the core 21 extend to the outside at both ends of the bobbin 22 and are each provided with a recess 25. The coil 20 is covered by a molded portion 23, and in applying this molded portion, the core 21 is held at the upper and lower surfaces of the core end portions, the molded portion 23 being formed integrally with a pair of studs 24 projecting laterally from both sides of the coil 20. By this process, high positional accuracy between the end portions of the core 21 and the studs 24 is ensured inspite of the fact that the studs 24 are disposed on the outer periphery of the coil 20.

The coil assembly 2 is inserted into the frame 11 in fitting projections 12 formed at the inner surfaces of the frame 11 into the grooves 25 at the end faces of the core end portions. This structure improves the mechanical strength of the frame 11 by using the iron core 21 as a central portion thereof.

As further shown in FIG. 1, upper and lower armatures 3, 4 of flat, rectangular frame-shape are provided. A rectangular frame-like balancing spring 35 is mounted on the upper surface of the upper armature 3. A pair of permanent magnets 5 is disposed at opposite sides on the upper surface of the lower armature 4, each magnet 5 being located between a pair of connecting pins 41 extending from the lower armature 4. The lower surface of the upper armature 3 and the upper surface of the lower armature 4 are provided with integrally formed actuating noses 31 disposed opposite each other at an end of respective edges of the armatures. Bearing members 30 are provided at the centers of both sides of both armatures 3, 4 at the inner edges of their frame-shapes so as to project upwardly from the lower armature 4 and downwardly from the upper armature 3.

In assembling, the armatures 3, 4 are disposed so as to surround the coil assembly 2, which itself has been mounted in the frame 11. The connecting pins 41 projecting upwardly from the lower armature 4 are fitted into bores 32 in the upper armature 3 thereby connecting the two armatures 3, 4 so that they are maintained parallel to each other. At the same time, the two pairs of upper and lower bearing members 30 provided at both armatures 3, 4 sandwich the pair of studs 24 extending from the molded portion 23 of the coil assembly 2, and the pair of permanent magnets 5 abut with their upper surfaces against the lower surface of the upper armature 3. The thus completed armature assembly is supported for pivotal movement about the horizontal axis defined by the pair of studs 24. The contact springs 6 are sandwiched between the opposing actuating noses 31 provided at the inner surfaces of the upper and lower armatures 3, 4. Also, the contact units formed by the contact springs 6 and the fixed contacts 8 are disposed within a shielded space S enclosed by the permanent magnets 5 and the upper and lower armatures 3, 4 as shown in FIG. 4. Thus, the coil 20 and the contact units are magnetically shielded from each other so that surges from the contact side (output side) are prevented from influencing the coil side (input side), in other words, the electronic circuit at the input side is protected against being damaged by surges occurring at the output side. In FIG. 4, the molded portion 23 of the coil assembly 2 is not shown.

After the coil assembly 2 has been inserted in the frame 11 and the armature assembly has been completed around the coil assembly and the contact units, the casing is closed by placing the upper and lower covers 9, 10 on the respective edges of the frame 11 with sealant being disposed between the contacting surfaces of these casing portions as explained above.

As shown in FIG. 1, the coil 20 has its wire ends connected to coil connecting portions 50 which project laterally from the ends of the core 21 extending from the coil. In the embodiment shown, a double-coil has been assumed, so that there are four coil connecting portions 50. When the coil assembly 2 is inserted into the frame 11, these coil connecting portions 50 come into engagement with portions 51 which are the inner ends of terminals 14. The engaging condition between these connecting portions 50 and 51 is shown in detail in FIG. 6.

As is also indicated in FIGS. 1 and 6, ribs 52 are formed integrally with said upper and lower covers 9, 10 so as to project inwardly with each rib 52 of the upper cover 9 facing a corresponding rib of the lower cover 10 at a position corresponding to the connecting portions 50 and 51. When the casing 1 is closed and the casing portions 9, 10 and 11 are bonded together by means of the sealant 53, the inner ends of the ribs 52 come in close proximity to the respective outer surfaces of the connecting portions 50, 51, and the gap therebetween is filled with the sealant due to capillary action. The insulation between the coil 20 and the contact terminals 14 is thus improved, and the breakdown voltage is increased without increasing the overall number of component parts of the relay or the number of steps in the process of manufacturing and assembling such relay.

In operation of the relay, when voltage is applied to the coil 20 to magnetize the upper and lower surfaces (pole faces) at both projecting ends of the iron core 21, magnetic attractive and repulsive forces are created between the ends of the core and the corresponding ends of the armatures 3, 4 which are magnetized by the permanent magnets 5. The armature assembly is thereby caused to pivot about the axis defined by the studs 24, thereby driving the contact springs 6 sandwiched between the actuating noses 31 into or out of engagement with the corresponding fixed contacts 8, respectively.

Adjustment of the switching characteristics of the relay by positioning the fixed contacts 8 will now be explained with reference to FIGS. 2, 3 and 5. Each fixed contact 8 is mounted on a pole plate 15 which has a pair of lugs 16 projecting from both sides at the central portion of the plate 15, as specifically shown in FIG. 2. These lugs 16 are embedded in a portion of the frame 11 and connected to a respective one of the terminals 14. The fixed contact 8 is mounted at a front end of the plate 15 at a position in which it opposes the contact portion 7 provided on the contact spring 6, whereas the rear end of the plate 15 projects beyond the tip of the spring 6. As shown in FIG. 3, an adjusting tool 17 may be used to press on the rear end of the plate 15 from above or below to rotate the plate 15 about a horizontal axis defined by the lugs 16 thereby varying the vertical position of the fixed contact 8, as shown in FIG. 5.

As will be appreciated from the above description, the studs 24 supporting the armature assembly are integral with the molded portion 23 covering the coil 20 so that the iron core 21 penetrating through the coil 20 and the studs 24 are in a fixed position relatively to each other and form a common block to be conveniently assembled and inserted into the relay frame 11. The relative position between the upper and lower surfaces provided at both ends of the iron core 21, which serve as the pole faces, and the end surfaces of the armatures 3 and 4 cooperating with these pole faces is thus reproduced with high accuracy, so that stable relay characteristics are obtained. Moreover, the pair of armatures 3, 4 and the contact units 6 are disposed at the lateral sides of the coil 20, so that the vertical dimension of the entire mechanism may be restricted to the height of the coil 20. Accordingly, a relay of thin structure is devised, without imposing restrictions on the coil design which may thus be wound with maximum efficiency. In addition, since the coil is covered by the molded portion 23, the contacts 7, 8, are not affected by gases or moisture from the coil winding.

We claim:

1. A balanced armature type relay comprising a coil assembly including a coil and a core penetrating through the coil and having end portions extending from the coil, an armature assembly including upper and lower armatures having end portions disposed opposite said core end portions and at least one permanent magnet disposed between said upper and lower armatures, said permanent magnet having a side which faces away from said coil assembly, the armature assembly being pivotal about an axis defined by a pair of studs, and at least one contact unit including a fixed contact, and a movable contact operated by said armature assembly for cooperation with said fixed contact, said contact unit being positioned laterally of said coil assembly within a space located between said upper and lower armatures and on that side of said permanet magnet which faces away from said coil assembly.

2. The relay of claim 1, wherein said upper and lower armatures have nose portions formed on surfaces facing each other for actuating said contact unit.

3. The relay of claim 1, wherein each of said upper and lower armatures have means which cooperate to form a pair of bearings for receiving said pair of studs.

4. The relay of claim 1, further comprising a casing including a frame member mounting said coil assembly and contact unit and having terminals connected to said coil and said contact unit and extending to the outside of the frame member, and upper and lower covers having peripheral portions engaging opposite edges of the frame member for sealingly enclosing said coil and armature assemblies and contact unit.

5. The relay of claim 4, wherein one of mutually engaging cover peripheral portion and frame edge one has a projection and the other has a groove receiving the projection, with a sealant being inserted between said groove and projection.

6. The relay of claim 4, wherein said coil has at least two end portions and at least two of said terminals have inner end portions connected to said coil end portions, and wherein ribs are formed integrally with said upper and lower covers adjacent said frame member so as to project inwardly of said casing and approach outer surfaces of said interconnected coil and terminal end portions.

7. The relay of claim 4, wherein said core end portions have recesses and said frame member has integrally formed inner projections engaging said recesses.

8. The relay of claim 1, wherein said coil assembly is covered by a molded portion and said studs are integrally formed at opposite lateral sides of said molded portion.

* * * * *